United States Patent [19]

Lipes

[11] 4,291,517

[45] Sep. 29, 1981

[54] METHOD AND APPARATUS FOR BAG FILLING, TIEING AND TRANSFER

[76] Inventor: Arnold Lipes, 6521 Merton Rd., Cote St. Luc, Quebec, Canada

[21] Appl. No.: 103,737

[22] Filed: Dec. 14, 1979

[51] Int. Cl.[3] ..... B65B 43/46; B65B 51/08

[52] U.S. Cl. ..... 53/468; 53/469; 53/138 A; 53/572; 53/573; 53/583; 493/214

[58] Field of Search ..... 53/468, 469, 459, 573, 53/572, 571, 570, 138 A, 583, 384; 93/20; 493/255, 308, 214, 215

[56] References Cited

U.S. PATENT DOCUMENTS

| | | | |
|---|---|---|---|
| 3,431,704 | 3/1969 | Smedlund | 53/572 X |
| 3,731,454 | 5/1973 | Crabb | 53/138 A X |
| 3,949,536 | 4/1976 | Chevalier | 53/384 X |
| 4,106,733 | 8/1978 | Walitalo | 53/572 X |
| 4,162,602 | 7/1979 | Achelpohl et al. | 53/459 X |
| 4,172,349 | 10/1979 | Lipes | 53/572 X |
| 4,177,621 | 12/1979 | Powell, Jr. | 53/468 |

*Primary Examiner*—James F. Coan

[57] ABSTRACT

A method and an apparatus for filling and transferring a bag while maintaining the extended tab of the bag slidingly secured on holding pins. A first bag from a plurality of juxtaposed bags is opened and filled while its extended tab is maintained stationary on holding pins. After the bag is filled, the bag is caused to be displaced on the holding pin to a bag tieing position. During the displacement of the bag to its tieing position, a neck portion is formed in the upper part of the bag and this neck portion is fed against an adhesive tape which is simultaneously secured about the neck portion as it is formed.

10 Claims, 3 Drawing Figures

METHOD AND APPARATUS FOR BAG FILLING, TIEING AND TRANSFER

BACKGROUND OF THE INVENTION (a) Field of the Invention

The present invention relates to a method and apparatus for filling a bag and transferring it to a remote location whilst maintaining the tab of the bag engaged on holding pins.

(b) Description of Prior Art

Various types of bag handling apparatus have been provided to automatically open bags and insert its contents therein and then releasing the bag on a conveyor where it is fed to a machine for tieing the open mouth of the bag with various tieing means. A disadvantage of such systems is that sometimes the articles positioned within the bag extend into the mouth opening or just below the mouth opening where a neck portion is to be formed in the bag and tied. Such article will cause a tieing machine, for example, to jam, resulting in stoppage of the feed conveyor and consequently the stopping of the filling operations, sometimes causing an entire bagging plant to become idle.

Another disadvantage of such systems is that the machinery utilized to tie the bags is relatively expensive, also requiring special conveyors and gates whereby to direct the open mouth bags with its contents therein to the tieing machine.

SUMMARY OF THE INVENTION

It is a feature of the present invention to substantially overcome the above-mentioned disadvantages.

It is a further feature of the present invention to provide a method of filling and transferring an open mouth bag while supporting the bag by an extended tab by the means of holding pins extending through holes in the tab.

A further feature of the present invention is to provide an apparatus for filling and transferring an open mouth bag from a filling location while maintaining the bag engaged by holding pins extending through an extended tab of the bag.

Another feature of the present invention is to provide a bag tieing apparatus which is relatively inexpensive and does not require a belt conveyor to feed open mouth bags thereto and wherein the bag is continuously held on holding pins extending through an extended tab of the bag while the bag is being filled and fed through an attachment means.

According to the above features, from a broad aspect, the present invention provides a method of filling and transferring an open mouth bag, said bag having an extended tab above a mouth opening, holes in said tab for supporting said bag on holding pins, said method comprising (i) holding said tab of a first bag to be opened from a plurality of juxtaposed bags, (ii) opening said mouth opening at a filling location, (iii) filling said bag with a product, (iv) releasing said tab to cause displacement of said first bag to a further location remote of said filling location while supporting said bag by said tab held by holding pins, (v) sealing said bag below said mouth opening to close said opening, and (vi) detaching said tab from said holding pins.

According to a further broad aspect of the present invention, there is provided an apparatus for filling and transferring an open mouth bag, said bag having an extended tab above a mouth opening, holes in said tab for supporting said bag on holding pins, said apparatus comprising bag support means having two spaced apart elongated holding pins, said pins being aligned to be received in said holes of said tab, said pins being disposed to define a bag transfer section extending from a bag filling location whereby said bag is displaced to a sealing location remote of said filling location while supporting said bag by said holding pins extending through said holes in said tab, said bag transfer section having a downwardly extending section of said pins leading to said bag sealing location remote from said filling location.

According to a further broad aspect of the present invention, there is provided a bag tieing apparatus comprising support means having two spaced apart pins extending in a common plane, said pins extending through a respective hole in an extended tab of a bag, said tab being disposed above a mouth opening of said bag, said pins converging toward one another to define a throat portion, attachment means located relative to said throat portion, means to displace said bag through said throat portion and into converging means to displace the side wall of said bag to converge to define a neck portion and feeding said neck portion into said attachment means to secure said neck portion.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
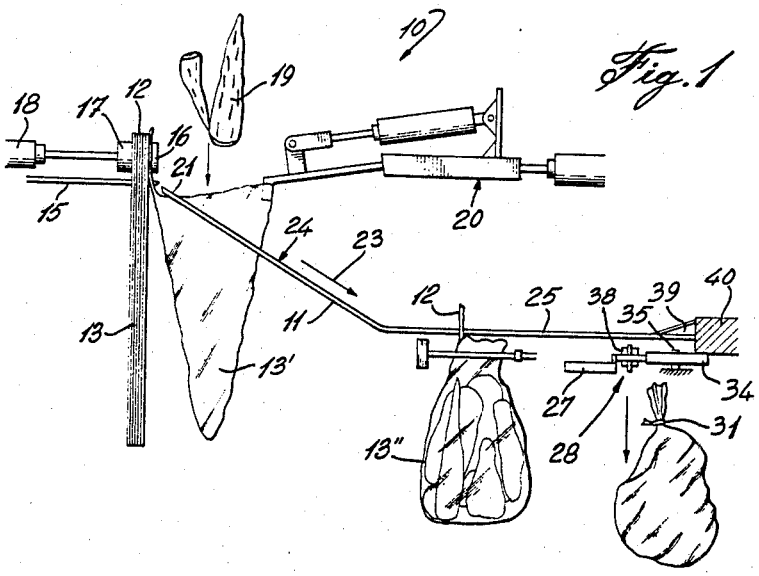
FIG. 1 is a simplified side view of the bag filling, transferring and tieing apparatus of the present invention.

Referring now to the drawings, and more particularly to FIG. 1, there is shown generally at 10, the bag filling, transferring and tieing apparatus of the present invention. The apparatus comprises a pair of spaced apart elongated holding pins 11 on which the extended tab 12 of a bag 13 is supported by means of the pins extending through a respective hole (not shown) provided in the tab 12. As shown in FIG. 1, a plurality of juxtaposed bags 13 are held on wicket pins 15 by holding means constituted by a stationary plate 16 and a pressure plate 17, herein shown activated by a piston 18.

As shown in FIG. 1, the first bag 13' of a plurality of juxtaposed bags 13 is open by bag opening apparatus 20 of the type, for example, as shown in my U.S. Pat. No. 4,172,349 issued on Oct. 30, 1979, whereby articles 19 may be inserted into the bag while the bag is still held with the tab engaged by the holding means. After the bag is filled, the bag opening apparatus 20 disengages itself with the bag and the holding means 16–17 releases the tab. As herein shown, the holding pins have a bag receiving end 21 which is in alignment with the free end of the wicket pins 15 and receives the tab of the bag as it is displaced by gravity due to the weight of the product in the bag. Thus, the tab 12 of the first bag 13' becomes engaged by the holding pins and the bag is displaced along the direction of arrow 23 along the transfer section 24 of the holding pins constituted by the inclined portion of the pins.

Figure 2:
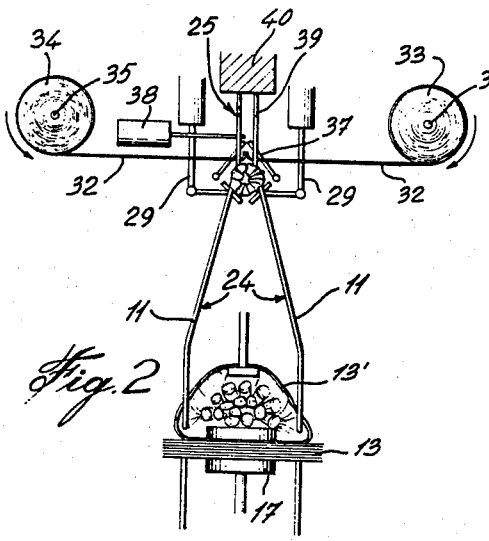
FIG. 2 is a top view of the apparatus of FIG. 1.

As shown more clearly in FIG. 2, the pins 11 converge toward each other along section 24 and the pins define a throat section 25 at a bottom end of the pins. The pins 11 are supported at their lower end by a rigid support 40. As the bag moves down the transfer section 24, the holes in the extended tab come closer together whereby the side wall 26 of the bag assumes a position whereby to be received in a converging gate 27 constituted by converging plates or walls or the like members. Thus, there is provided an apparatus for filling a bag and transferring the bag to a further location remote from the filling station whilst maintaining the extended tab of the bag engaged on holding pins.

Figure 3:
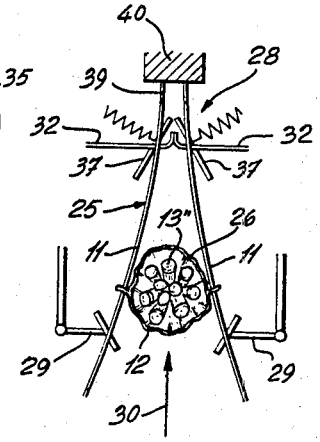
FIG. 3 is a simplified top view showing the bag tieing method.

As shown in FIG. 3, when the bag is in its position 13'', it is now ready to be displaced through the bag attachment means 28. Means, such as pusher arms 29, is provided to engage the bag at position 13'' and to move it through the bag attachment means 28. Other displacement means may be provided, such as a small conveyor located under the throat section 25 of the pins, in order to move the bags through the attachment means 28. As shown more clearly in FIG. 3, the bag 13'' is moved along the direction of arrow 30 by the arms 29 and into the converging gate 27, herein shown as spring biased gates. The gates will displace the side wall 26 of the bag 13' to converge to define a neck portion 31 below the mouth opening.

Attachment means, as herein shown, constituted by an adhesive tape 32, extends across the converging gate and adheres itself to the neck portion 31 of the bag as it is formed. The adhesive tape 32 is herein constituted by two rolls of tape 33 and 34 each having a free end which is secured to one another by abutment of their adhesive surface and extends in the path 30 of the neck portion 31 of the bag and adheres itself about the neck portion as the bag is pushed against the tape. As the bag is pushed against the tape, the rolls 33 and 34 supported on idler sprockets 35 will reel out the tape and as the bag moves out of the converging gate, the end portions 36 of the plates 37 forming the gate will cause the tapes 32 to come together again to maintain the tapes 32 in engagement whereby to receive the next neck portion of the other bag. Severing means, in the form of a piston activated knife 38 (see FIG. 2) is located just beyond the end 36 of the gate to sever the adhered portions of the tape from the bag.

The bag continues to move along the pins 11 by the pusher arms until the tab 12 is slit above the holes therein by the knives 39 and the bag then falls by gravity onto a conveyor (not shown) for feeding the tied bag.

As can be seen, with this novel method and apparatus for filling, transferring and tieing a bag, the bag is only detached from engagement after it is filled and tied and if any article extends into the mouth opening of the bag as it is being tied, this will not impair the operation of the machine as the bag will be tied with the article extending through the neck portion. Such bag can then be removed from the final conveyor line where the bags are fed to a container for shipping. Thus, the operation of the filling machines may continue without stoppage due to malfunction of another machine. If there is malfunction of the bag attachment means 28, it is only the bag opening means 20 that will be idled, thus a single machine being idled rather than a plurality of such machines feeding a common conveyor associated with a tieing machine.

It is within the ambit of the present invention to incorporate any obvious modifications to the preferred embodiment herein disclosed, provided such modifications fall within the scope of the appended claims. For example, the holding pins 11 may be extended to replace the wicket pins 15 and a plurality of juxtaposed bags would be supported on the holding pins 11 and loaded from a free end thereof. Also, as above-described, the means to displace the bag, such as link arms 29, may be constituted by other displacement means and the converging gate 27 may be formed differently. Furthermore, other attachment means may be provided as long as it can conveniently secure the neck portion of the bag. However, the adhesive tape 32 is the preferred means as it is not dependent on forming an accurate size neck portion below the open mouth of the bag. The tape, however, could be incorporated in a cassette for easier replacement.

A further embodiment of the transfer system is to maintain the pins 11 parallel to each other throughout the transfer section 24 and the section 25. Thus, the throat configuration is eliminated. The bag with its contents are then fed to the sealer which applies a heat seal across the opposed side walls of the bag, as is known in the art.

It is foreseeable that with this type of sealer and maintaining the pins parallel, that the bags 13 may be loaded from the end adjacent the sealer and supported at their top end. The bags, with their contents and sealed, may then be discharged from the free bottom end of the pins.

I claim:

1. A method of filling and transferring an open mouth bag, said bag having an extended tab above a mouth opening, holes in said tab for supporting said bag on holding pins, said method comprising:

(i) holding said tab of a first bag to be opened from a plurality of juxtaposed bags, (ii) opening said mouth opening at a filling location, (iii) filling said bag with a product, (iv) releasing said tab to cause displacement of said first bag to a further location remote of said filling location while supporting said bag by said tab held by holding pins, (v) sealing said bag below said mouth opening to close said opening, and (vi) detaching said tab from said holding pins.

2. A method as claimed in claim 1 wherein there is further provided the steps of:

(v) sealing said bag below said mouth opening to close said opening, and (vi) releasing said tab from said holding pins.

3. A method as claimed in claim 1 wherein said step (iv) comprises (i) causing said filled bag to be displaced due to its own weight by maintaining said tab engaged on downwardly sloping holding pins leading to said further location.

4. A method as claimed in claim 1 wherein said step (v) comprises (i) causing the wall of said bag below said mouth opening to converge to define a neck portion, and (ii) applying an adhesive tape about said neck portion to secure said neck portion.

5. An apparatus for filling and transferring an open mouth bag, said bag having an extended tab above a mouth opening, holes in said tab for supporting said bag on holding pins, said apparatus comprising bag support means having two spaced apart elongated holding pins, said pins being aligned to be received in said holes of said tab, said pins being disposed to define a bag transfer section extending from a bag filling location whereby said bag is displaced to a sealing location remote of said filling location while supporting said bag by said holding pins extending through said holes in said tab, said bag transfer section having a downwardly extending section of said pins leading to said bag sealing location remote from said filling location.

6. An apparatus as claimed in claim 5 wherein said holding pins have a bag receiving end aligned with a free end of a respective one of two wicket pins supporting a plurality of juxtaposed bags.

7. An apparatus as claimed in claim 5 wherein said pins are disposed substantially parallel to each other, said bag transfer section comprising a downwardly extending section of said pins leading to a bag sealing section remote from said filling location.

8. An apparatus as claimed in claim 5 wherein said bag sealing section comprises a throat portion defined by a closely spaced section of said holding pins, an adhesive tape supported across said throat portion, a converging gate in alignment with said throat portion to cause the side wall of said bag below said mouth opening to converge to define a neck portion and to cause said tape to adhere about said neck, and severing means to cut said tape at a location remote of said neck.

9. A bag tieing apparatus comprising support means having two spaced apart pins extending in a common plane, said pins extending through a respective hole in an extended tab of a bag, said tab being disposed above a mouth opening of said bag, said pins converging toward one another to define a throat portion, attachment means located relative to said throat portion, means to displace said bag through said throat portion and into converging means to displace the side wall of said bag to converge to define a neck portion and feeding said neck portion into said attachment means to secure said neck portion.

10. An apparatus as claimed in claim 9 wherein said attachment means is an adhesive tape supported across said throat portion, said tape being simultaneously fastened about said neck as said neck is formed, and means to sever said tape at a location remote from said neck portion.

* * * * *